US007594818B1

(12) United States Patent
Asai

(10) Patent No.: US 7,594,818 B1
(45) Date of Patent: Sep. 29, 2009

(54) SOCKET FOR ELECTRONIC PART INSTALLATION

(75) Inventor: Kiyoshi Asai, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/275,364

(22) Filed: Nov. 21, 2008

(30) Foreign Application Priority Data

May 14, 2008 (JP) ..... 2008-127222

(51) Int. Cl.
*H01R 12/00* (2006.01)

(52) U.S. Cl. ..... 439/71

(58) Field of Classification Search ..... 439/71, 439/607, 608, 609, 496
See application file for complete search history.

(56) References Cited

U.S. PATENT DOCUMENTS 7,086,902 B1 * 8/2006 Yang ..... 439/607.36
7,309,238 B2 * 12/2007 Yang ..... 439/71
7,467,974 B2 * 12/2008 Zhang ..... 439/607.01
7,473,134 B2 * 1/2009 Zhang ..... 439/607.01
2005/0215087 A1 * 9/2005 Asai et al. ..... 439/71
2008/0233797 A1 * 9/2008 Hsu et al. ..... 439/607

* cited by examiner

*Primary Examiner*—Neil Abrams
*Assistant Examiner*—Phuong Nguyen
(74) *Attorney, Agent, or Firm*—Darby & Darby PC

(57) ABSTRACT

A socket for mounting on a substrate includes a terminal exposure part that exposes the plurality of substrate connection terminals of the contacts at lower opposing edges of the socket, and a central part that includes a bottom surface bulging part that protrudes downwardly to define a bottom surface of the socket housing. An insulative contact support board that houses the contacts is housed inside a thickness of the bulging part. A bottom surface of a substrate connection terminal of the contacts supported by the contact support board is exposed at the terminal exposure part. A bottom surface bulging part is inserted into a housing bottom mating hole formed in the connection substrate, and the substrate connection terminal is connected to a pattern terminal provided on the upper surface of an edge of the housing bottom mating hole.

7 Claims, 5 Drawing Sheets

SOCKET FOR ELECTRONIC PART INSTALLATION

CROSS-REFERENCE TO RELATED APPLICATION

The present application claims priority under 35 U.S.C. §119 to Japanese Patent Application No. JP2008-127222, filed May 14, 2008, and which is hereby incorporated by reference herein it its entirety.

FIELD OF THE INVENTION

The present invention relates to a socket for electronic part installation for installing a camera module.

BACKGROUND OF THE INVENTION

In the past, when installing a camera module on printed circuit board arranged inside electronic equipment such as a portable telephone, and the like, camera modules susceptible to heat could not by installed by direct soldering. Therefore, a socket for installing electronic parts was used and connected to the printed circuit board.

The main socket for installing electronic parts connected a camera module to a connecting substrate through contacts by: providing a socket housing, which had an electronic part receptor upwardly facing and including by a bottom base part and a peripheral wall constituting front, rear, right and left standing walls standing around the periphery of the bottom base part, and a plurality of contacts supported in the socket housing. The flexible contact pieces are provided as a single unit with the contacts protruding to the inner surface of the electronic part receptor. By inserting a camera module into the electronic part receptor, the terminals of the camera module and the flexible contact pieces contact (for example, see Japanese Unexamined Laid-Open Patent Application No. 2007-26765 ("the '765 application"), No. 2005-268020 ("the '020 application") and No. 2005-276626 ("the '626 application)).

Alternatively, as connection substrate and socket contact connection systems, there exist systems that expose contact substrate side connection terminals at the bottom surface of a housing, and surface mount this housing to the substrate by soldering to printed circuit pattern terminals (for example, see the '765 application and the '020 application); and systems that provide a flange-shaped extension part in a single unit at a position of intermediate height on the periphery of the housing and provide on the substrate an opening in which a part lower than a support part of the housing is inserted. A pattern terminal is provided on the peripheral part of that opening; and mounts by inserting substantially the lower half of the aforementioned housing into an opening in the substrate. Substrate connection terminals of contacts exposed to the lower surface of the extension part are soldered to pattern terminals on the substrate (for example, see the '626 application).

Moreover, as a contact accommodation system in relation to the housing, to make the flexible contact pieces of the contacts have a more satisfactory force of elastic deformation requires that the flexible contact pieces have long parts capable of elastic deformation. For that reason, in the past, the flexible contact pieces have been formed in a single unit through a flexed part bent back in a U-shape in relation to the support part that supports the contacts in relation to the housing.

Systems to accommodate this support part and flexed part may accommodate these parts inside the thickness of a bottom plate that includes the electronic part receptor of the housing (see, e.g., the '020 application), and systems that accommodate these parts within the peripheral wall of the same (see, e.g., the '765 application).

In the conventional examples described above, the system of mounting by inserting the lower side of the housing into the connection substrate (as in the '626 application) lowers the installation height in relation to the substrate of the socket substrate more than does the system of soldering the connection terminals exposed at the bottom surface of the housing to pattern terminals of the surface of the substrate. However, there is the disadvantage that the surface area occupied by the surface of the substrate becomes broader because the substrate connecting terminals are exposed on the low surface of the expansion part that extends in a flange-shape at the body of the housing.

Conversely, the system of soldering the substrate connection terminals exposed to the bottom surface of the housing to the pattern terminals on the substrate surface (as in the '765 application and the '020 application) requires a smaller substrate surface area as compared to the system of mounting by inserting the lower side of the housing into the connecting substrate, but there is the disadvantage that the installation height in relation to the substrate is high.

Moreover, the system of accommodating in the peripheral wall thickness the support part and the flexed part folded back in a U-shape (as in the '626 application) lowers the installation height in relation to the substrate surface more than does the system of accommodation in the bottom plate thickness, but has the disadvantage that the horizontal width and the surface area occupied on the substrate surface are enlarged. Conversely, however, the system of accommodation in the bottom plate thickness makes for a smaller horizontal width and less surface area occupied on the substrate surface than does the system that accommodates in the peripheral wall thickness, but the installation height in relation to the substrate surface is higher.

SUMMARY OF THE INVENTION

The present invention addresses conventional problems like those described above, and an object is to offer a socket for electronic part installation that when surface mounted in relation to the substrate occupies less surface area and also has a lower height after installation.

To resolve conventional problems like those described above, the present invention is directed to a socket for installing electronic devices, having a socket housing with an electronic part receptor opened upward and made such that a flexible contact piece of a contact is exposed at the inner bottom surface of the electronic part receptor. A contact terminal exposed to a bottom surface of an electronic device to be mated with the aforementioned electronic part receptor is pressure contacted to the flexible contact piece.

A substrate connection terminal of the contact is exposed at an outside bottom surface of the socket housing. The substrate connection terminal makes electrical connection with a printed wiring pattern terminal on a connection substrate surface. A terminal exposure part of the socket housing that exposes the substrate connection terminal is positioned at a bottom edge of the socket housing, together with a centrally-positioned bottom surface bulging part that protrudes downward. The terminal exposure part and the bottom surface bulging part are included in a single unit on the bottom surface of the socket housing. An insulative contact support board that supports the contact is housed inside an internal cavity of the bulging part. The substrate connection terminal of the contact supported by the contact support board is exposed at the terminal exposure part, and the bottom surface bulging part is inserted into a housing bottom mating hole formed in the connection substrate. The substrate connection terminal of the contact may thereby be connected to a pattern terminal provided on an upper surface of the connection substrate at the housing bottom mating hole.

The socket housing may include a box-shape shield case made from a metal shield material, and a contact support board built into an inner bottom part of the shield case. The shield case may further include a bottom plate part that defines a bottom surface of the socket housing, and a peripheral wall part with a shape standing up from the periphery of the bottom plate part. A window hole may be formed as of the terminal exposure part; such that the substrate connection terminal supported on the contact support board is exposed in the window hole.

The bottom plate part and left and right standing walls forming the peripheral wall of the shield case may be formed by a single metal plate, and front and rear standing walls forming the peripheral wall may straddle and be fixed between ends of the left and right standing walls.

An earth terminal may be exposed inside the window hole of the terminal exposure part as a single body with the shield case, and configured for soldering to an earth pattern terminal of the substrate.

The left and right standing walls may include an interlocking piece interposed between the ends of the left and right standing walls in a single body with the left and right standing walls, on both ends of the front and rear standing walls. The earth terminal exposed in the window hole of the terminal exposure part may be formed in a single body on the interlocking piece, for soldering to an earth pattern terminal of the substrate.

In the socket according to the present invention, the bottom surface bulging part is inserted into a housing bottom mating hole formed in the connection substrate, and the substrate connection terminal of the contact is connected to a pattern terminal provided on an upper surface of the connection substrate at an edge of the housing bottom mating hole. Therefore, the thickness necessary to elastically form the contact spring part of the contact may be confined within the thickness of the contact support board, and the thickness of this contact support board, as a bulging part, can be housed inside the housing bottom mating hole part provided on the substrate, making a low mounting height for electronic parts in relation to the substrate. Moreover, the socket installation surface area necessary on the substrate surface can be made smaller by making the connection between the substrate and the substrate side terminal of the contact below the bottom surface of the electronic part, and by arranging the thickness necessary for the elastic deformation of the contact on the bottom surface side, and not on the peripheral wall, of the socket.

Moreover, in the present invention, the socket housing has a box-shape shield case comprising a metal shield material, and a contact support board built into the inner bottom part of the aforementioned shield case. The shield case includes a bottom plate part that defines the bottom surface of the socket housing, and a peripheral wall part with a shape standing up from the periphery of the bottom plate part. A window hole opening up and down is formed on the terminal exposure part of the bottom plate part; and the substrate connection terminal supported on the contact support board is exposed in the aforementioned window hole. Therefore, the shape of the insulative material necessary to support the contact can be made surprisingly compact, and because the other part is constituted by the shield case itself, the overall shape can be made smaller and compact. As a result, the number of parts can be reduced, and the cost can be decreased.

According to the present invention, the bottom plate part and left and right standing walls may be formed of a single metal plate, and the front and rear standing walls comprising the peripheral wall straddle and are fixed between both ends of the left and right standing walls. As a result, the production assembly of the shield case can be simplified and costs can be reduced.

In addition, the earth terminal exposed inside the window hole of the terminal exposure part is provided in a single body with the shield case, and the earth terminal is soldered to an earth pattern terminal of the substrate. As a result, the socket can be fixed securely to the board.

Further, the left and right standing walls and an interlocking piece between the ends of the left and right standing walls may be provided in a single body on both ends of the front and rear standing parts. The earth terminal exposed in the window hole of the terminal exposure part may be provided in a single body on the interlocking piece, and the earth terminal may be soldered to the earth pattern terminal of the substrate. Therefore, the shielding effect of the socket is heightened, because the parts constituting the shield case are connected directly to the earth terminal of the substrate, and the parts of the shield case can be fixed securely to the substrate.

BRIEF DESCRIPTION OF THE DRAWINGS

The invention will become more readily apparent from the Detailed Description of the Invention, which proceeds with reference to the drawings in which.

DETAILED DISCLOSURE OF THE INVENTION

Figure 1:
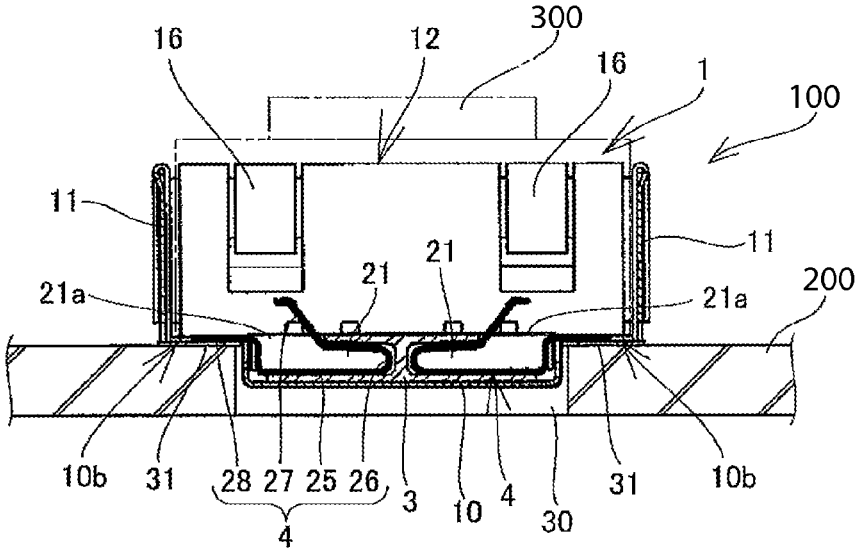
FIG. 1 is a longitudinal cross-sectional diagram depicting a first embodiment of a socket according to the present invention in a state in which it has been secured to a connection substrate.

The following table provides a key to some of the elements and associated reference numerals depicted in the drawings.

| | |
|---|---|
| 100 | Socket housing |
| 200 | Connection substrate |
| 300 | Electronic device |
| 1 | Shield case |

-continued

| | |
|---|---|
| 1a | First member |
| 1b | Second member |
| 1c | Third member |
| 2 | Contact support board |
| 3 | Pattern terminal |
| 4 | Contact |
| 10 | Bottom plate |
| 10a | Bulging part |
| 10b | Standing piece |
| 10c | Standing piece |
| 11 | Right and left standing wall |
| 11a | Latching through hole |
| 12 | Front and rear standing wall |
| 12a | Outer wall plate |
| 12b | Inner wall plate |
| 10a | Bulging part |
| 10b | Terminal exposure part |
| 14 | Window hole |
| 15 | Interlocking piece |
| 15a | Bulging part side standing part |
| 15b | Horizontal part |
| 15c | Peripheral wall side standing part |
| 15d | Earth terminal |
| 16 | Plate spring part for latching electronic parts |
| 17 | Contact support board retaining piece |
| 17a | Horizontal part |
| 17b | Perpendicular part |
| 18 | Peripheral wall side interlocking piece |
| 18a | Inner wall plate |
| 18b | Outer wall plate |
| 18c | Protrusion |
| 20 | Latching concave part |
| 21 | Contact receptacle |
| 21a | Upper surface opening |
| 21b | Contact press fit groove |
| 25 | Rectangular support plate part |
| 26 | Fold back spring piece |
| 27 | Contact spring piece |
| 28 | Substrate connection terminal |
| 28a | Standing part |
| 28b | Contact part |
| 30 | Housing bottom mating hole |
| 31 | Pattern terminal part |
| 32 | Latching part |
| 35 | Earth terminal |

Next, embodiments of the socket for installing electronic parts related to the present invention will be explained based on the examples indicated in the diagrams. Element 100 in FIG. 1 is a socket housing that configures a socket for installing electronic parts according to the present invention, and element 200 is a connecting substrate formed as a printed circuit board.

The socket housing 100 is composed of a shield case 1 and an insulative contact support board 2 incorporated into the bottom of the shield case 1; and the socket is configured by incorporating on the contact support board 2 a plurality of contacts 4 that cause electrical connection between a pattern terminal 31 of the connection substrate B and a terminal on an electronic device 300 such as a camera module mounted on the electronic part housing part inside the socket housing 100.

Figure 2:
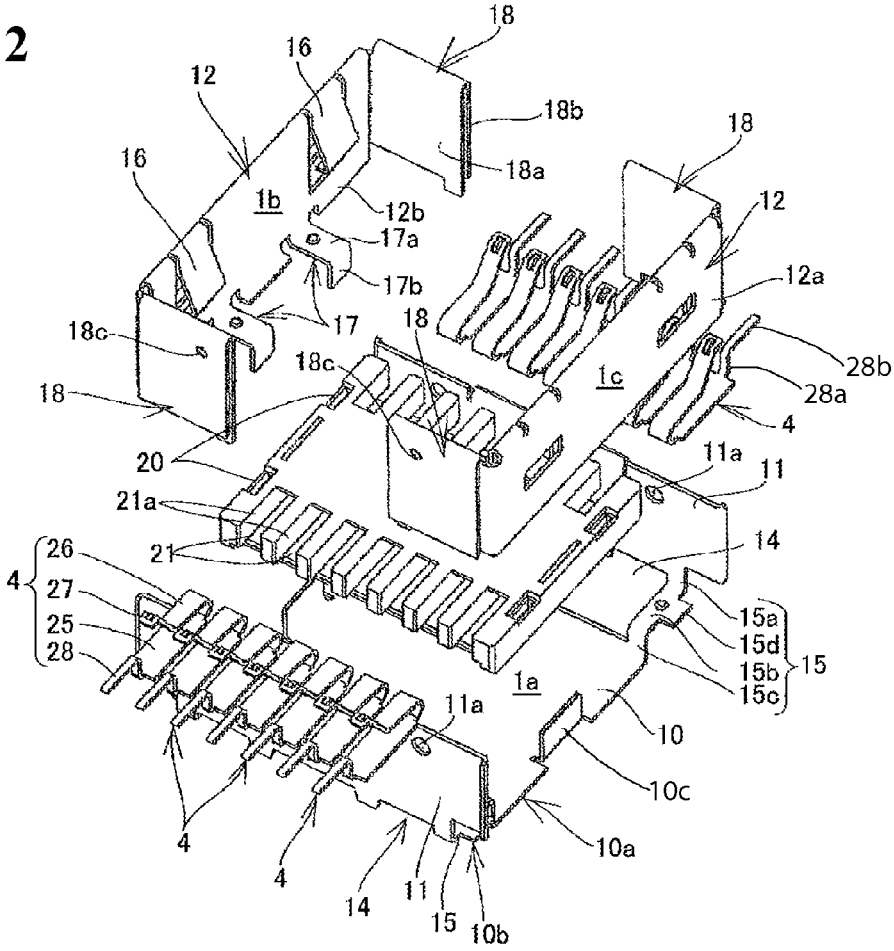
FIG. 2 is a disassembled perspective view of the socket depicted in FIG. 1.
Figure 3:
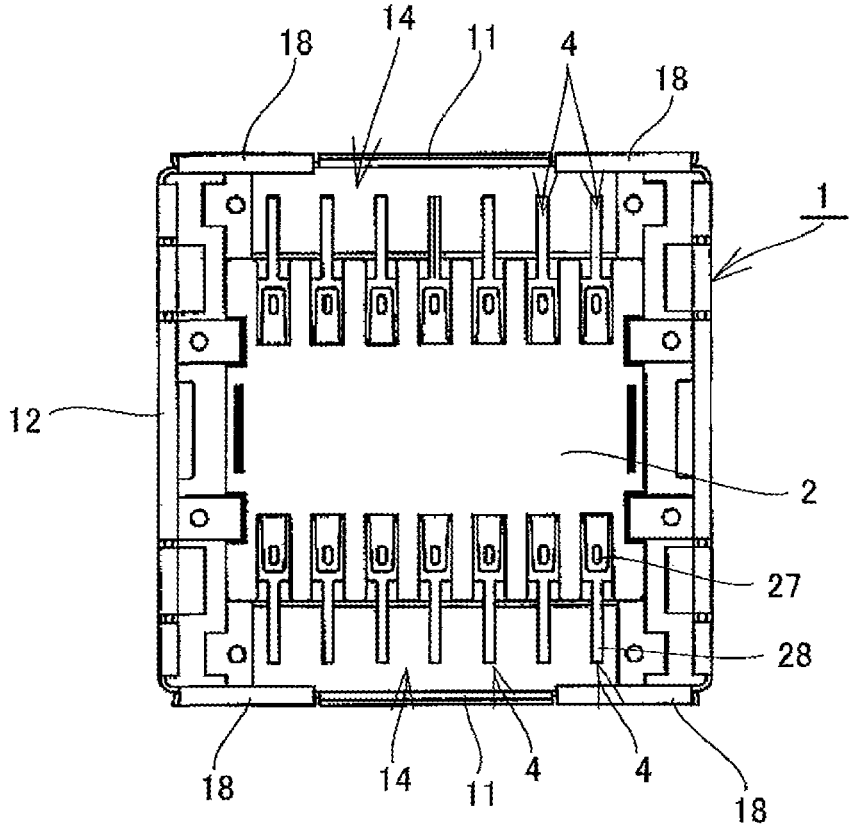
FIG. 3 is a top view diagram of the socket depicted in FIG. 1.
Figure 4:
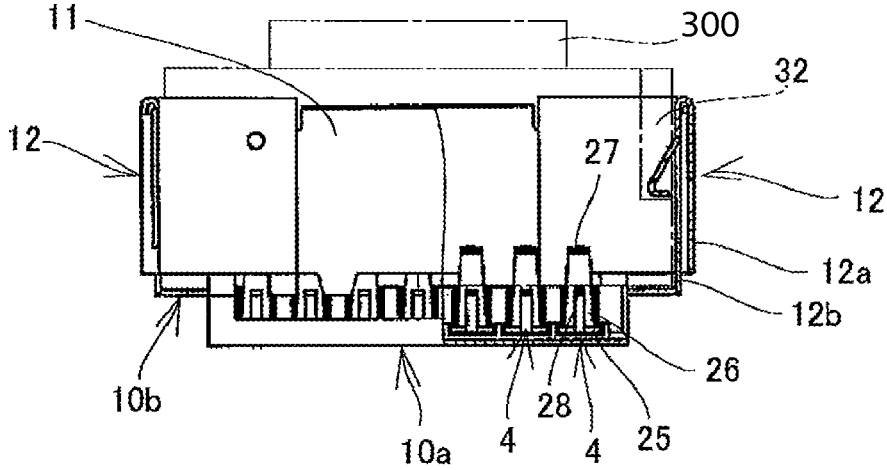
FIG. 4 is front view diagram indicating a longitudinally cutaway section of a right half of the socket depicted in FIG. 1.
Figure 5:
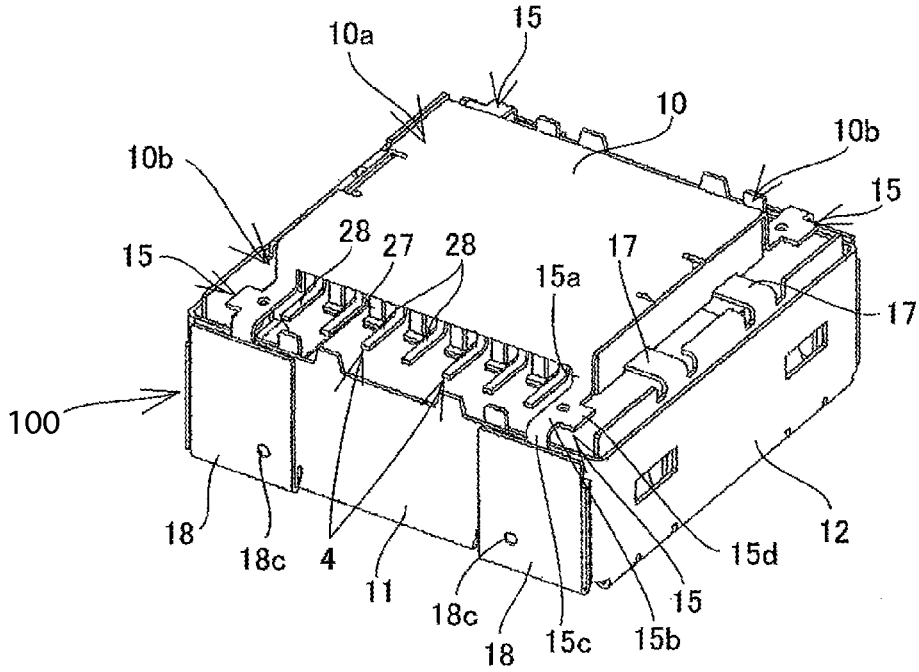
FIG. 5 is perspective diagram viewed from the bottom surface of the socket depicted in FIG. 1.

As shown in FIG. 2, the shield case 1 is composed of a first member 1*a*, in which bottom plate 10 and left and right standing wall parts 11 are formed, for example, by punching out and bending a single metal plate, and similarly shaped second and third members 1*b* and 1*c* that form front and rear standing wall parts 12.

The bottom plate 10 of the first member 1*a* includes a bulging part 10*a* having a rectangular flat plate shape, and left and right terminal exposure parts 10*b* arranged on both edges and at one stage higher than the bottom surface of bulging part 10*a*; and window holes 14 are formed on both terminal exposure parts 10*b*. Each window hole 14 is formed between interlocking pieces 15 on both edge positions of the terminal exposure part 10; these interlocking pieces 15 are composed of bulging part side standing parts 15*a*, which have a length equal to the height of the bulge and rise up at both ends of both edges of the bulging part 10*a*, horizontal parts 15*b* that extend to the outside, and peripheral wall side standing parts 15*c* that extend upward from the upper edge of the horizontal parts 15*b*. Left and right standing wall parts 11 are extended upwardly from the bulging part side standing parts 15*a*.

An earth terminal 15*d*, which may be connected to an earth pattern terminal 31*a* of the connection substrate B by soldering, is preferably formed in a single body on the side edge of the horizontal part 15*b* of this interlocking piece 15.

Second and third members 1*b*, 1*c* have substantially the same shape, and inner wall plates 12*b* of front and rear standing walls 12 are formed by bending the upper margin of an outer wall plate 12*a* backward into a U-shape. Plate spring parts 16 are formed in the inner wall plates 12*b* for locking electronic parts, and contact support board retaining pieces 17 extend from each inner wall plate 12*b*.

Peripheral wall side interlocking pieces 18 are formed in a single body at both edges of the outer wall plates 12*a* of the front and real standing walls 12. Each interlocking piece 18 is extended along the outer wall plate 12*a* of the standing wall 11 to form inner wall plate 18*a*, and is then bent back over the upper edge of the wall plate into a U-shape to form the outer wall plate 18*b*; Front edges of the left and right standing wall parts 11 are interposed between the wall plates 18*a* and 18*b*. Further, protrusions 18*c* toward the inner wall plate 18*a* side are preferably formed in the outer wall plate 18*b* of the peripheral wall side interlocking pieces 18 to mate with latching through holes 11*a* formed on the ends of the left and right standing walls 11. The protrusions 18*c* are retained by the latching through holes 11*a* by snapping in.

Each contact support board retaining piece 17 constitutes a horizontal part 17*a* facing from the lower edge of the inner wall plate 12*b* to the interior of the housing, and a perpendicular part 17*b* that is bend downward the end of the retaining piece; the lower end of the perpendicular part 17*b* mates with a latching concave part 20 on the upper surface of the contact support board 2, and the contact support board 2 thereby is restricted from upward movement from inside the bulging part 10*a*.

The contact support board 2, which is made by molding an insulative synthetic resin into a flat plate shape, mates inside of the bulging part 10*a* of the bottom plate 10, is prevented from moving in left and right directions by the bulging part left and right standing pieces 10*b*, and is prevented from moving in front and rear directions by the standing pieces 10*c* that stand in the center of the front and rear edges of the bulging part.

Further, the upper side of this contact support board 2 provides an electronic part receptacle into which the electronic part such as a camera module is inserted. The upper surface of the contact support board 2, the upper surfaces of the horizontal parts 17 of the contact support board latching pieces 17, and the upper surfaces of the horizontal parts 15*b* of the interlocking pieces 15, which constitute both ends of the window hole, are formed to have roughly equivalent heights. These upper surfaces, which are enclosed by the left and right standing wall parts 11 and the front and rear standing wall parts 12 of the shield case 1, provide an upwardly open electronic part receptacle.

A plurality of contact receptacles 21 is provided on the contact support board 2 in two serial arrangements along the left and right edges. These contact receptacles 21 are formed to extend from the left and right edge surfaces of the contact support board 2 inwardly to slightly in front of the central area of this contact support board 2. Upper surface openings 21*a* along each of the left and right edges of the contacts support board 2 together amount to roughly half the length of each respective edge. Longitudinally oriented press fit insertion grooves are provided on both bottom sides of each contact receptacle 21.

As indicated in FIGS. 1 and 2, each contact 4 is composed of a rectangular support plate part 25, a fold back spring piece 26, which is formed as a single body with the end of the support plate part and is bent back in a U-shaped fold back shape, a contact spring piece 27, which is bent is the shape of the Japanese character "人" and provides the highest peak portion, and a substrate connection terminal part 28 formed in a single body with the base end side of the support plate part 25. The support plate part 25 is formed to a width that enables press fitting into the contact press fit grooves on both bottom edges of the previously described contact receptacle 21, and the fold back spring piece 26 and contact spring piece 27 are formed to a width narrower than that of the contact receptacle and protrude to the surface of the contact support board 2 such that the peak part of contact spring piece 27 having the shape of the Japanese character "人" becomes a moveable contact point.

Each substrate contact terminal 28 is composed of a standing part 28*a* that stands up from the base end part support plate part 25, and a contact part 28*b* that is the end bent down horizontally; and this contact part 28*b* is lined up with and inserted into the window hole 14 formed in the bottom plate part 10 of the shield case 1, and a bottom surface of the contact part 28*b* is exposed at a position with a height nearly equivalent to that of the bottom side opening of the window hole 14.

Figure 6:
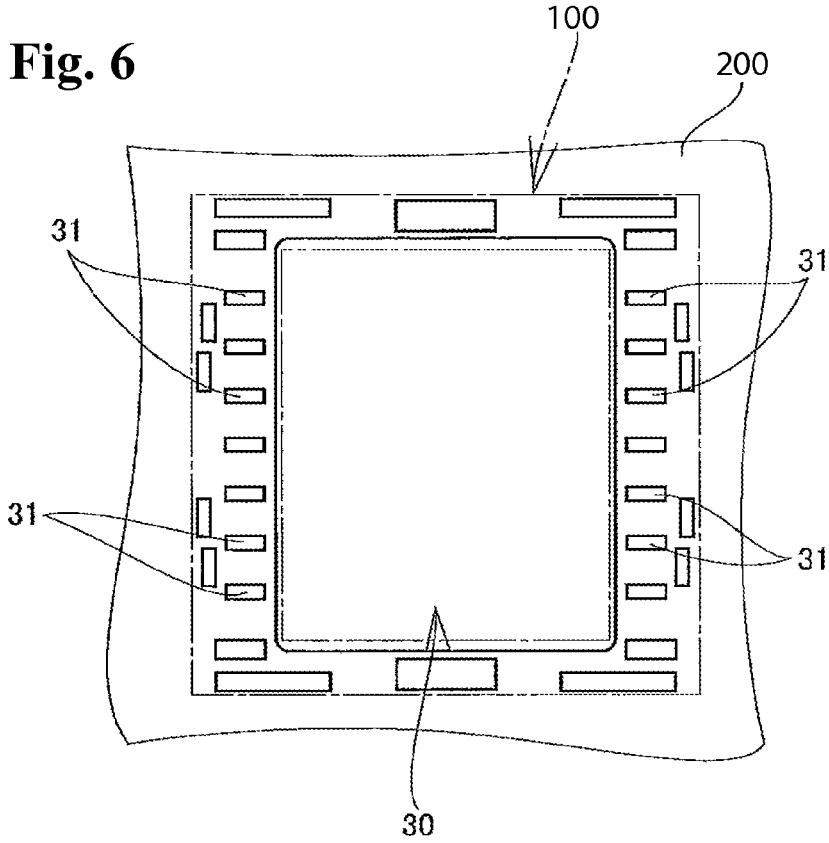
FIG. 6 is a partial top view diagram of the connection substrate with the socket depicted in FIG. 1 installed and shown in phantom lines.

A housing bottom mating hole 30 of the connection substrate 200 through which the aforementioned bulging part 10*a* is inserted as indicated in FIGS. 1 and 6, is formed as a through hole formed in the connection substrate 200 for mounting the socket configured in this way, and pattern terminals 31 are arranged on the top surface of opposing edge parts of the housing bottom mating hole 30. Then, the contacts 4 and the shield case 1 are connected to the printed wiring of the connection substrate B by inserting the bulging part 10*a* into the housing bottom mating hole 30 and soldering the earth terminals 15*d* and the substrate contact terminal parts 28 of the contacts 4 exposed by the terminal exposure part 10*b* on both sides of the bulging part to the patters terminal 31, thus supporting the socket on the connection substrate 200.

Formed on both side surfaces of the electronic device 300, which is mounted on the connection substrate 200 using this socket, are cutaway staged latching parts (not shown), which latch with plate springs 16 for latching electronic parts that are formed on the front and rear standing walls 12 of the shield case, and the connecting terminals (not indicated in the diagrams) of the electronic device 300 are exposed on the bottom surface. By pressing the electronic device 300 from the opening into the electronic part receptacle of the housing, the plate spring parts 16 for latching electronic parts are latched and detained in the latching parts of the electronic device 200. In this state, the connection terminals on the bottom surface press on to and make contact with the Japanese character "人" shaped peaks of the contract spring pieces 27 of the contacts 4, thus providing electrical continuity through the contacts to the pattern terminal parts 31 of the connection substrate 200.

Figure 7:
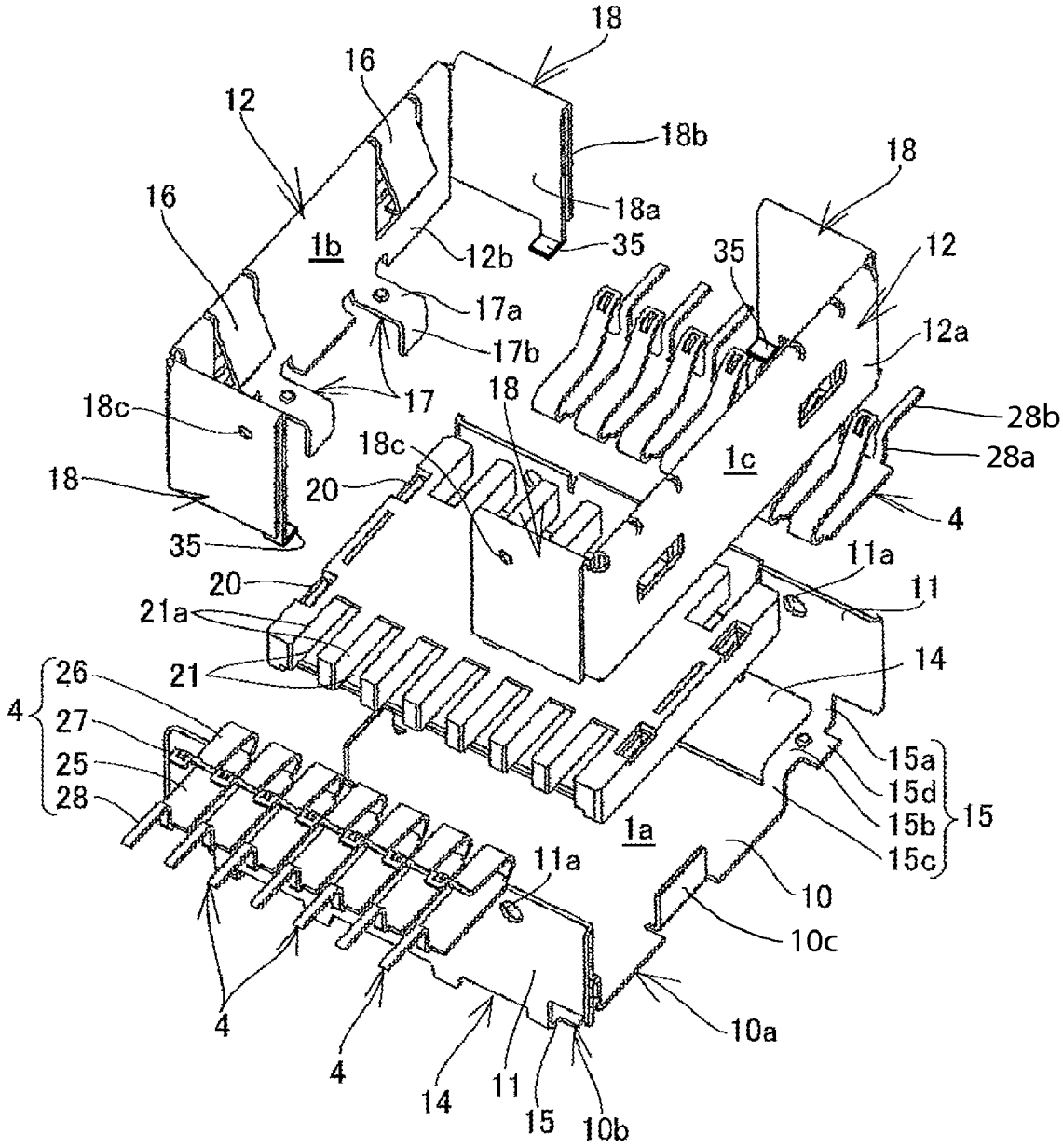
FIG. 7 is disassembled perspective view of a second embodiment of a socket according to the present invention.
Figure 8:
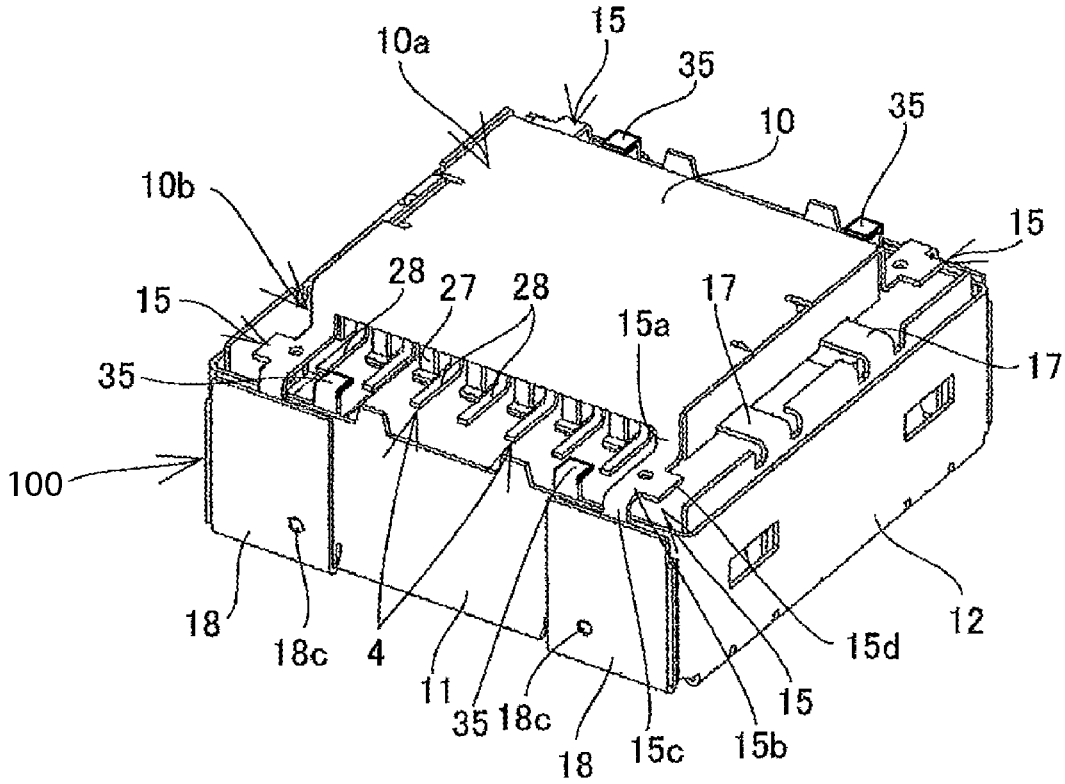
FIG. 8 is a perspective diagram viewed from the bottom surface of the socket depicted in FIG. 7.

Further, in the embodiment described above, the securing of the shield case 1 to the substrate and the continuity to the earth terminal was based on the earth terminals 15*d* of the first member 1*a*, but as indicated in FIGS. 7 and 8, earth terminals 35 can alternatively be provided in a single body with the peripheral side interlocking pieces 18 of the second and third members 1*b* and 1*c*, and these may be soldered to an earth pattern terminal of the connection substrate 200. Further, explanation of the same codes for the same parts as in the embodiment indicated in FIGS. 1 to 6 will be omitted.

All of the first to third individual parts constituting the shield case 1 are secured to the substrate by soldering, and continuity to the earth terminal is directly provided, yielding a highly effective shield.

Those skilled in the art will readily recognize numerous adaptations and modifications which can be made to the present invention which fall within the spirit and scope of the present invention as defined in the claims. Moreover, it is intended that the scope of the present invention include all foreseeable equivalents to the elements and structures as described with reference to FIGS. 1-8. Accordingly, the inventions is to be limited only by the scope of the claims and their equivalents.

The invention claimed is:

1. A socket for installing electronic parts, comprising:

a socket housing with an electronic part receptor, the electronic part receptor being upwardly open for receiving an electronic device; and a plurality of contact terminals each having a flexible contact piece for making a pressure contact with the electronic device when the electronic device is mated with the electronic part receptor, and each having a substrate connection terminal that is exposed at an outside bottom surface of said socket housing; for making electrical connection with one of a plurality of printed wiring pattern terminals on a connection substrate surface, wherein the socket further comprises:

a terminal exposure part of the socket housing and a bottom surface bulging part of the socket housing centrally located on the socket housing and including a first member that protrudes downwardly to define a bottom surface of said socket housing;

an insulative contact support board that supports the plurality of contact terminals, said insulative contact support board being housed in an interior cavity of said bulging part; and wherein:

each substrate connection terminal is exposed at said terminal exposure part;

said bottom surface bulging part is insertable into a housing bottom mating hole formed in said connection substrate, such that said substrate connection terminals may be positioned for making electrical connection to one of the plurality of printed wiring pattern terminals provided on said connection substrate surface adjacent to an edge of said housing bottom mating hole;

said socket housing comprises a box-shaped shield case comprising a metal shield material, and said insulative contact support board is provided at an inner bottom part of said shield case, said shield case comprises a bottom plate part that defines a bottom surface of said socket housing, and a peripheral wall part with a shape standing up from the periphery of said bottom plate part; and said terminal exposure part comprises a window hole exposing said substrate connection terminals supported on said contact support board.

2. The socket for installing electronic parts according to claim 1, wherein an earth terminal exposed inside the window hole of said terminal exposure part is provided in a single body with said shield case, and said earth terminal being configured for soldering to the earth pattern terminal of said substrate.

3. The socket for installing electronic parts according to claim 2, wherein each of said left and right standing wall parts further includes interlocking pieces projecting from ends of each of the front and rear standing wall parts.

4. The socket for installing electronic parts according to claim 1, wherein the bottom plate part and left and right standing walls constituting said peripheral wall of said shield case are formed of a single metal plate, and the front and rear standing walls comprising said peripheral wall straddle and are fixed between both ends of the left and right standing walls.

5. The socket for installing electronic parts according to claim 4, wherein each of said left and right standing wall parts further includes interlocking pieces projecting from ends of each of the front and rear standing wall parts; and an earth terminal exposed inside the window hole of said terminal exposure part is formed in a single body on one of said interlocking pieces; and said earth terminal being configured for soldering to the earth pattern terminal of said substrate.

6. The socket for installing electronic parts according to claim 4, wherein an earth terminal exposed inside the window hole of said terminal exposure part is provided in a single body with said shield case, and said earth terminal is soldered to the earth pattern terminal of said substrate.

7. The socket for installing electronic parts according to claim 6, wherein each of said left and right standing wall parts further includes interlocking pieces projecting from ends of each of the front and rear standing wall parts.

* * * * *